US010271137B1

(12) United States Patent
Jeong et al.

(10) Patent No.: US 10,271,137 B1
(45) Date of Patent: Apr. 23, 2019

(54) METHOD AND APPARATUS FOR DETECTING SOUND EVENT USING DIRECTIONAL MICROPHONE

(71) Applicant: Electronics and Telecommunications Research Institute, Daejeon (KR)

(72) Inventors: Young Ho Jeong, Daejeon (KR); Sang Won Suh, Daejeon (KR); Jae-hyoun Yoo, Daejeon (KR); Tae Jin Lee, Daejeon (KR); Woo-taek Lim, Daejeon (KR); Hui Yong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 16/018,359

(22) Filed: Jun. 26, 2018

(30) Foreign Application Priority Data

Mar. 20, 2018 (KR) ..... 10-2018-0032034

(51) Int. Cl.
*H04R 3/00* (2006.01)
*G10L 25/51* (2013.01)
*H04R 1/40* (2006.01)

(52) U.S. Cl.
CPC ..... *H04R 3/005* (2013.01); *G10L 25/51* (2013.01); *H04R 1/406* (2013.01)

(58) Field of Classification Search
CPC ..... H04R 3/005; H04R 1/406; G10L 25/51
See application file for complete search history.

(56) References Cited

U.S. PATENT DOCUMENTS

2001/0007969 A1* 7/2001 Mizushima ..... G01S 3/8086 702/76
2013/0009791 A1* 1/2013 Yoshioka ..... G08G 1/166 340/935
2015/0063069 A1* 3/2015 Nakadai ..... G01S 3/802 367/118
2015/0281842 A1 10/2015 Yoo et al.
2017/0214446 A1 7/2017 Rappaport
2017/0249936 A1* 8/2017 Hayashida ..... G10L 15/04
2017/0251319 A1 8/2017 Jeong et al.
2017/0251323 A1 8/2017 Jo et al.
2018/0249267 A1* 8/2018 Klingler ..... H04R 1/406
2018/0303079 A1* 10/2018 Marka ..... A01G 22/00

FOREIGN PATENT DOCUMENTS

KR 10-1661106 B1 9/2016
KR 10-2017-0054752 A 5/2017

* cited by examiner

*Primary Examiner* — Simon King
(74) *Attorney, Agent, or Firm* — NSIP Law

(57) ABSTRACT

A method of detecting a sound event includes receiving sound signals using one or more directional microphones, extracting a time interval of each of the sound signals, extracting time information and an azimuth of a sound event included in the sound signals during the extracted time interval, mixing the sound signals received from the directional microphones using the extracted time interval, and determining a direction of the sound event generated at a specific time from a mixed sound signal obtained through the mixing using the extracted time information and azimuth of the sound event.

16 Claims, 8 Drawing Sheets

METHOD AND APPARATUS FOR DETECTING SOUND EVENT USING DIRECTIONAL MICROPHONE

CROSS-REFERENCE TO RELATED APPLICATIONS

This application claims the benefit under 35 USC § 119(a) of Korean Patent Application No. 10-2018-0032034 filed on Mar. 20, 2018, in the Korean Intellectual Property Office, the entire disclosure of which is incorporated herein by reference for all purposes.

BACKGROUND

1. Field

The following description relates to a method and apparatus for detecting a sound event using a directional microphone, and more particularly, to a sound event detecting method and apparatus that may determine a direction in which a sound event is generated using time information and an azimuth of the sound event.

2. Description of Related Art

Various sounds, such as, for example, screams, car horns, baby cries, impact sounds, dog barks, and thunders, which are also referred to herein as sound events, are heard every day. For users including elderly users with a weakened sense of hearing and hearing-impaired users, technology for recognizing such sound events may be needed because it may help those users effectively avoid a dangerous situation that is not visually recognized.

Thus, such a sound event recognizing technology has recently been receiving a great deal of interest because it is applicable to various fields of application including, for example, facility security and surveillance, potential danger recognition, location recognition, and multimedia event detection.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect provides a method and apparatus for detecting a sound event that may effectively recognize a sound event generated unexpectedly, and detect a direction in which the sound event is generated.

Another aspect provides a method and apparatus for detecting a sound event that may determine a direction in which a sound event is generated by effectively recognizing the sound event using a time interval of a sound signal, and time information and an azimuth of the sound event.

Still another aspect provides a method and apparatus for detecting a sound event that may determine a direction in which a sound event is generated by mapping time information of the sound event and an azimuth of the sound event.

In one general aspect, a method of detecting a sound event includes receiving sound signals using one or more directional microphones, extracting a time interval of each of the sound signals, extracting time information and an azimuth of a sound event included in the sound signals during the extracted time interval, mixing the sound signals received from the directional microphones using the extracted time interval, and determining a direction of the sound event generated at a specific time from a mixed sound signal obtained through the mixing using the extracted time information and azimuth of the sound event.

The mixing of the sound signals may include determining a mixing interval in which the sound signals are mixed by comparing the extracted time intervals of the sound signals.

The determining of the mixing interval may include determining whether sound signals are generated in a same time interval by comparing the time intervals of the sound signals received by the directional microphones, and selectively mixing the sound signals generated in the same time interval.

The determining of the direction of the sound event may include identifying the time information of the sound event from the mixed sound signal, and determining the direction of the sound event based on the azimuth corresponding to the identified time information of the sound event.

The determining of the direction of the sound event may include determining the direction of the sound event using the specific time of the sound event included in the identified time information of the sound event.

A polar pattern of each of the directional microphones may indicate an area in which each of the directional microphones receives a sound signal. Through a combination of polar patterns of the directional microphones, the sound signals may be received from all directions.

In another general aspect, a method of detecting a sound event includes identifying a time interval of a sound signal input to each of directional microphones that is obtained from the sound signal and a sound event, and time information and an azimuth of the sound event, mixing the received sound signals by comparing the identified time intervals of the sound signals, and determining a direction of the sound event generated at a specific time from a mixed sound signal obtained through the mixing using the identified time information and azimuth of the sound event.

The mixing of the sound signals may include determining a mixing interval in which the sound signals are mixed by comparing the time intervals of the sound signals.

The determining of the mixing interval may include determining whether sound signals are generated in a same time interval by comparing the time intervals of the sound signals received by the directional microphones, and selectively mixing the sound signals generated in the same time interval.

The determining of the direction of the sound event may include identifying the time information of the sound event from the mixed sound signal, and determining the direction of the sound event based on the azimuth corresponding to the identified time information of the sound event.

In still another general aspect, an apparatus for detecting a sound event includes a processor. The processor may be configured to receive sound signals using one or more directional microphones, extract a time interval of each of the sound signals, extract time information and an azimuth of a sound event included in the sound signals during the extracted time interval, mix the sound signals received from the directional microphones using the extracted time interval, and determine a direction of the sound event generated at a specific time from a mixed signal obtained through the mixing using the extracted time information and azimuth of the sound event.

The processor may be further configured to determine a mixing interval in which the sound signals are mixed by comparing the extracted time intervals of the sound signals.

For the determining of the mixing interval, the processor may be further configured to determine whether sound signals are generated in a same time interval by comparing the time intervals of the sound signals received by the directional microphones and selectively mix the sound signals generated in the same time interval.

For the determining of the direction of the sound event, the processor may be further configured to identify the time information of the sound event from the mixed sound signal, and determine the direction of the sound event based on the azimuth corresponding to the identified time information of the sound event.

For the determining of the direction of the sound event, the processor may be further configured to determine the direction of the sound event using the specific time of the sound event included in the identified time information of the sound event.

A polar pattern of each of the directional microphones may indicate an area in which each of the directional microphones receives a sound signal. Through a combination of polar patterns of the directional microphones, the sound signals may be received from all directions.

In yet another general aspect, an apparatus for detecting a sound event includes a processor. The processor may be configured to identify a time interval of a sound signal input to each of directional microphones that is obtained from the sound signal and a sound event, and time information and an azimuth of the sound event, mix the received sound signals by comparing the identified time intervals of the sound signals, and determine a direction of the sound event generated at a specific time from a mixed sound signal obtained through the mixing using the identified time information and azimuth of the sound event.

For mixing the sound signals, the processor may be further configured to determine a mixing interval in which the sound signals are mixed by comparing the time intervals of the sound signals.

For determining the mixing interval, the processor may be further configured to determine whether sound signals are generated in a same time interval by comparing the time intervals of the sound signals received by the directional microphones, and selectively mix the sound signals generated in the same time interval.

For determining the direction of the sound event, the processor may be further configured to identify the time information of the sound event from the mixed sound signal, and determine the direction of the sound event based on the azimuth corresponding to the identified time information of the sound event.

According to example embodiments described herein, it is possible to effectively recognize a sound event generated unexpectedly and to detect a direction in which the sound event is generated.

According to example embodiments described herein, it is possible to determine a direction in which a sound event is generated by effectively recognizing the sound event using a time interval of a sound signal, and time information and an azimuth of the sound event.

According to example embodiments described herein, it is possible to determine a direction in which a sound event is generated by mapping time information of the sound event and an azimuth of the sound event.

Other features and aspects will be apparent from the following detailed description, the drawings, and the claims.

Figure 1:
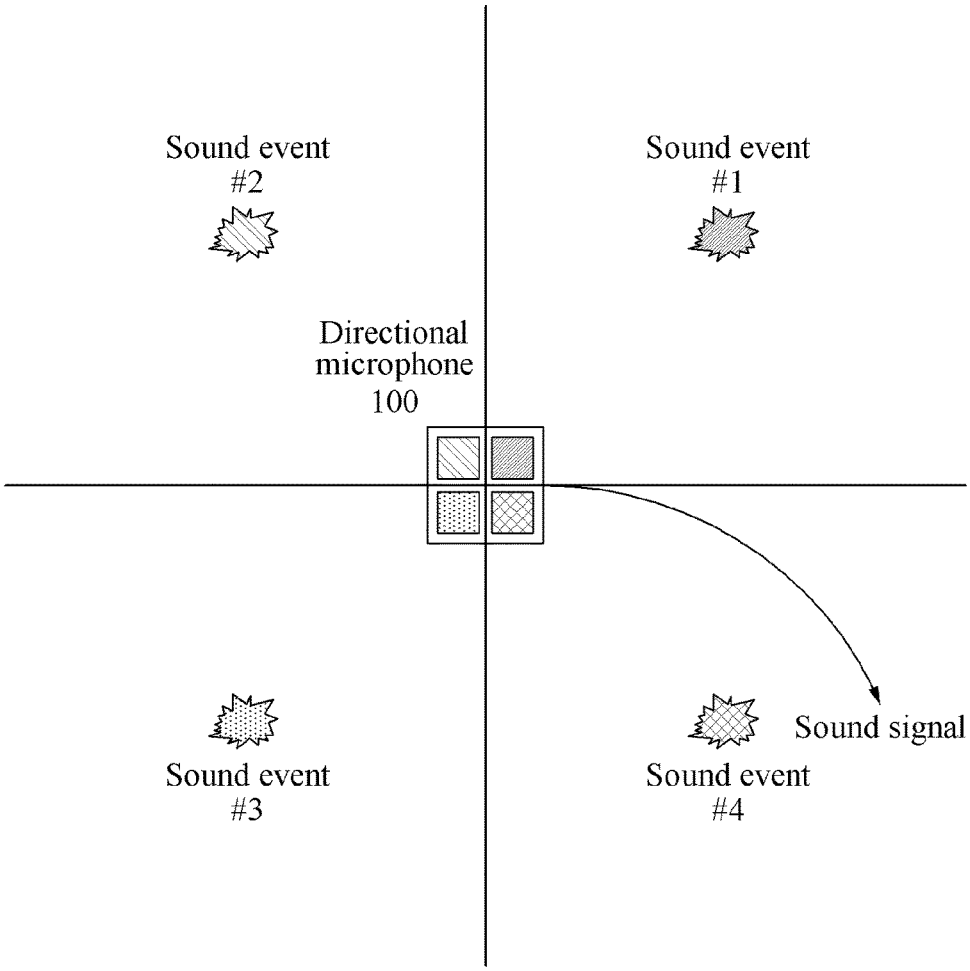
FIG. 1 is a diagram illustrating an example of a situation in which a sound event to be received by a directional microphone is generated according to an example embodiment.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, operations, elements, and/or components, but do not preclude the presence or addition of one or more other features, integers, operations, elements, components, and/or groups thereof.

Terms such as first, second, A, B, (a), (b), and the like may be used herein to describe components. Each of these terminologies is not used to define an essence, order, or sequence of a corresponding component but used merely to distinguish the corresponding component from other component(s). For example, a first component may be referred to as a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings.

FIG. 1 is a diagram illustrating an example of a situation in which a sound event to be received by a directional microphone is generated according to an example embodiment.

In sound recognition, an object to be recognized is divided into a sound event and a sound scene. The sound event indicates a sound object that occurs at a specific time and then disappears and includes, for example, screams, dog barks, and the like. The sound scene indicates a set of sound events occurring at a specific location, for example, a restaurant, an office, a home, a park, and the like.

The sound scene may be relatively highly recognizable than the sound event. This is because a sound event occurring at a specific location may be limited, and thus a sound scene at the location may also be limited. Thus, a sound scene at a specific location may be highly predictable, and may thus be highly recognized.

In contrast, the sound event indicates a sound that suddenly occurs at an unspecific location, and thus such a sound may not be predictable. The sound event may thus be relatively less recognizable because it is not readily predictable, unlike the sound scene from which a potential sound is predictable due to limited sound events.

Technology for recognizing a sound event may be classified into monophonic recognition and polyphonic recognition based on the number of sound events to be simultaneously recognized using directional microphones. The monophonic recognition may recognize a single sound event at a specific time, and the polyphonic recognition may recognize one or more sound events at a specific time.

According to an example embodiment, an apparatus for detecting a sound event, hereinafter simply referred to as a "sound event detecting apparatus," may recognize a sound event generated in all directions in a radius of 360 degrees)(° around a listener through the polyphonic recognition. For example, the sound event detecting apparatus may recognize a sound event generated in all directions in a radius of 360° around a listener using an omnidirectional microphone.

According to another example embodiment, the sound event detecting apparatus may separate sound events by applying sound source separation technology to a sound signal generated in all 360° directions of a listener. The sound event detecting apparatus may determine an azimuth of each of the separated sound events, and recognize each sound event through the monophonic recognition.

According to still another example embodiment, the sound event detecting apparatus may recognize a sound event generated in all directions in a radius of 360° around a listener using one or more directional microphones. The sound event detecting apparatus may determine a direction of the sound event generated by the directional microphones. As illustrated in FIG. 1, a directional microphone 100 may receive a sound signal and output a sound signal.

The directional microphone 100 may have a polar pattern, and detect a sound event generated in all directions in a radius of 360° around a listener. For example, as illustrated, a first sound event, a second sound event, a third sound event, and a fourth sound event are detected by the directional microphone 100.

The first through fourth sound events may be generated simultaneously, or at different times. The generated first through fourth sound events may be received by the directional microphone 100. For example, the first and second sound events may be generated simultaneously, and the third and fourth sound events may be generated at different times. The directional microphone 100 may receive the first and second sound events that are generated simultaneously, and receive and the third and fourth sound events that are generated at different times.

Herein, the directional microphone 100 receiving a sound event may have a polar pattern, which indicates an area in which the directional microphone 100 receives a sound signal and/or a sound event. Herein, the sound event may be included in the sound signal.

In detail, the directional microphone 100 may include one or more directional microphones. The directional microphone 100 including the one or more directional microphones may thus receive a sound signal generated in all directions of a listener. For example, in a case in which the directional microphone 100 includes four directional microphones, the four directional microphones may receive a sound signal generated in all directions of a listener.

In an example, sound signals received by the directional microphone 100 may be selectively mixed based on a time interval of each of the sound signals. A direction in which a sound event of a mixed sound signal obtained through the mixing may be detected using a time interval and an azimuth of the sound event.

According to an example embodiment, the sound event detecting apparatus may recognize a sound event generated in all directions in a radius of 360° around a listener using one or more directional microphones, and detect a direction in which the sound events is generated. Thus, the sound event detecting apparatus may be used in various fields of application, such as, for example, risk avoidance for smart cars, facility security and surveillance, multimedia event detection, and automatic multimedia tagging.

Figure 2:
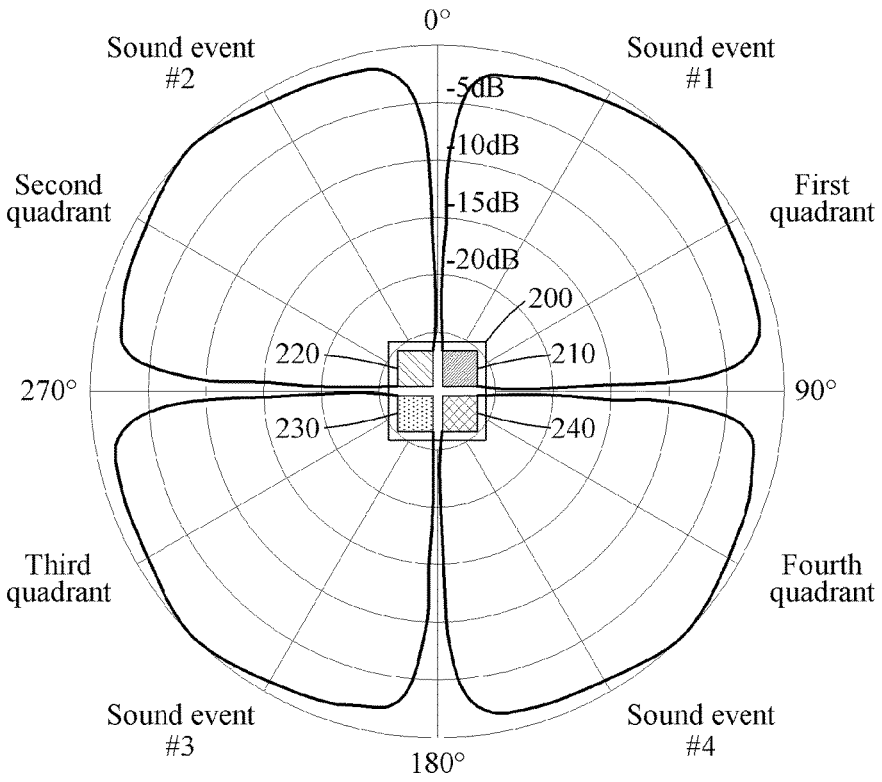
FIG. 2 is a diagram illustrating an example of a polar pattern of a directional microphone according to an example embodiment.

FIG. 2 is a diagram illustrating an example of a polar pattern of a directional microphone according to an example embodiment.

A polar pattern of a directional microphone indicates an area in which the directional microphone receives a sound signal and/or a sound event. The polar pattern of the directional microphone may be indicated as various patterns.

For example, in a case in which a polar pattern of a directional microphone is divided by 180°, the directional microphone may receive a sound signal and/or a sound event generated at 0° to 180°, or a sound signal and/or a sound event generated at 180° to 360°.

For another example, in a case in which a polar pattern of a directional microphone is divided by 120°, the directional microphone may receive a sound signal and/or a sound event generated at 0 to 120°, a sound signal and/or a sound event generated at 120° to 240°, or a sound signal and/or a sound event generated at 240° to 360°.

For still another example, in a case in which a polar pattern of a directional microphone is divided by 90°, the directional microphone may receive a sound signal and/or a sound event generated at 0° to 90°, a sound signal and/or a sound event generated at 90° to 180°, a sound signal and/or a sound event generated at 180° to 270°, or a sound signal and/or a sound event generated at 270° to 360°.

For yet another example, in a case in which a polar pattern of a directional microphone is divided by 60°, the directional microphone may receive a sound signal and/or a sound event generated at 0° to 60°, a sound signal and/or a sound event generated at 60° to 120°, a sound signal and/or a sound event generated at 120° to 180°, a sound signal and/or a sound event generated at 180° to 240°, a sound signal and/or a sound event generated at 240° to 300°, or a sound signal and/or a sound event generated at 300° to 360°.

Other patterns may be used as a polar pattern of a directional microphone based on a situation. Alternatively, a polar pattern of a directional microphone may be adjusted to be another pattern based on a situation.

In the example illustrated in FIG. 2, a polar pattern of a directional microphone 200 is divided by 90°. Referring to FIG. 2, the directional microphone 200 includes four directional microphones, for example, a directional microphone 210, a directional microphone 220, a directional microphone 230, and a directional microphone 240.

In detail, the directional microphone 210 having a polar pattern corresponding to a first quadrant from 0° to 90° receives a first sound event. The directional microphone 220 having a polar pattern corresponding to second quadrant from 90° to 180° receives a second sound event. The directional microphone 230 having a polar pattern corresponding to a third quadrant from 180° to 270° receives a third sound event. The directional microphone 240 having a polar pattern corresponding to a fourth quadrant from 270° to 360° receives a fourth sound event. That is, sound signals and/or sound events may be received separately by each of the directional microphones 210 through 240, and a feature of each sound signal and/or sound event may be analyzed.

A sound signal and/or a sound event that is close to a directional microphone may be received by the directional microphone although a magnitude of the sound signal and/or the sound event is relatively small. However, a sound signal and/or a sound event that is remote from a directional microphone may be received when a magnitude of the sound signal and/or the sound event is relatively large.

For example, in a case of a sound signal and/or a sound event that is close to the directional microphone 210, the directional microphone 210 may receive the sound signal and/or the sound event although a magnitude thereof is small, for example, −20 decibels (dB). However, in a case of a sound signal and/or a sound event that is remote from the directional microphone 210, the directional microphone 210 may receive the sound signal and/or the sound event when a magnitude thereof is relatively large, for example, −5 dB.

Figure 3:
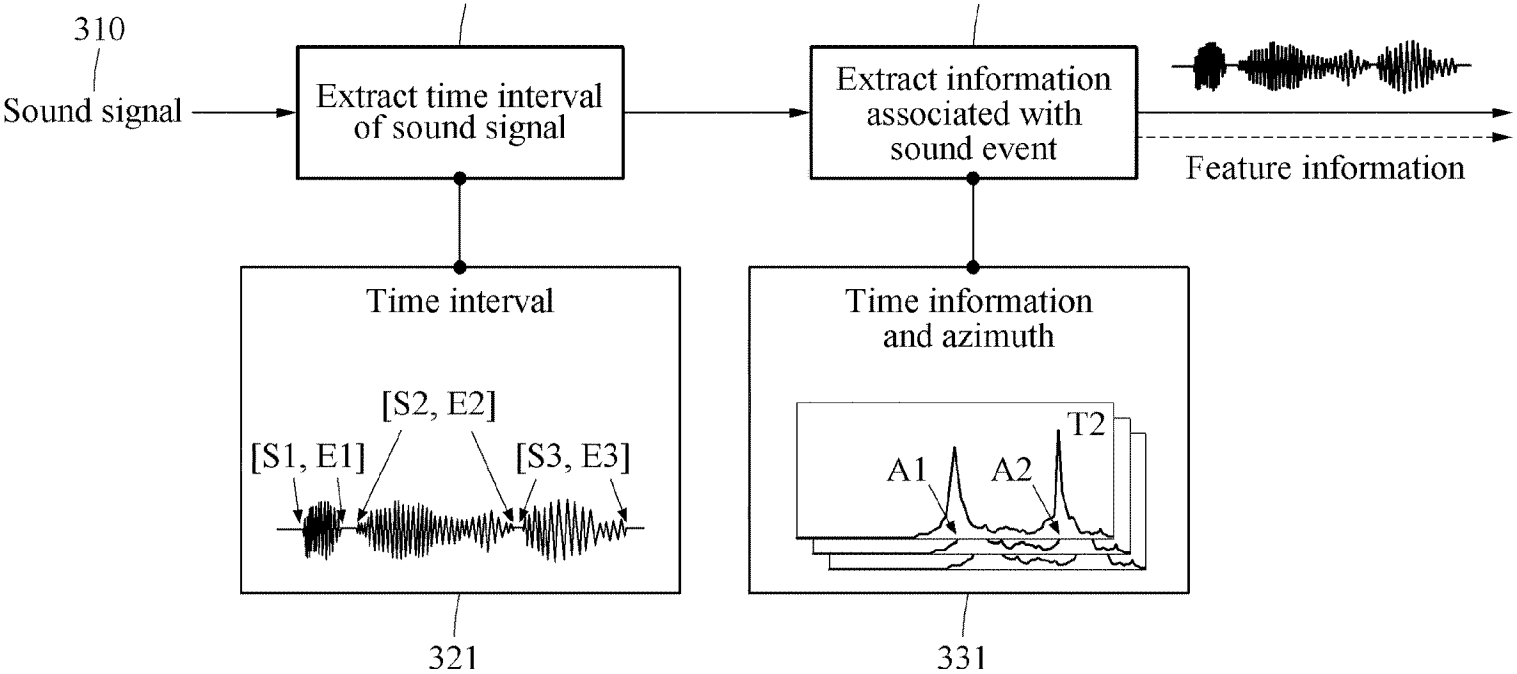
FIG. 3 is a diagram illustrating an example of how to extract necessary information from a sound signal and a sound event according to an example embodiment.

FIG. 3 is a diagram illustrating an example of how to extract necessary information from a sound signal and a sound event according to an example embodiment.

Referring to FIG. 3, a sound event detecting apparatus receives a sound signal 310. The sound signal 310 may include one or more sound events generated at a specific time.

In operation 320, the sound event detecting apparatus extracts a time interval 321 of the sound signal 310 from the received sound signal 310. The sound signal 310 may include one or more time intervals. For example, as illustrated, a first time interval may be indicated by [S1, E1] including start time S1 and end time E1, a second time interval may be indicated by [S2, E2] including start time S2 and end time E2, and a third time interval may be indicated by [S3, E3] including start time S3 and end time E3. That is, the sound signal 310 may include the first time interval, the second time interval, and the third time interval. Herein, the time interval 321 is extracted, among the time intervals, from the sound signal 310.

In operation 330, the sound event detecting apparatus extracts information 331 associated with a sound event included in the extracted time interval 321 of the sound signal 310. The information 331 associated with the sound event may include time information and an azimuth of the sound event. The time information of the sound event may include a time interval during which the sound event lasts, and a generation time and a termination time of the sound event. The time information may also include a specific time in addition to the generation time and the termination time. The specific time indicates a specific point in time in the time interval during which the sound event lasts.

For example, a sound event may be included in the first time interval of the sound signal 310, and the sound event detecting apparatus may extract time information and an azimuth of the sound event. That is, the sound event detecting apparatus may extract the time information and the azimuth of the sound event based on the time information and the azimuth of the sound event and polyphonic sound event recognition information.

In detail, as illustrated, the sound event included in the first time interval [S1, E1] of the sound signal 310 may have the time information and the azimuth of the sound event. In addition, a generation time, a termination time, a specific time, and a time interval of the sound event may also be included in the first time interval [S1, E1] of the sound signal 310. The time information of the sound event may include information associated with the generation time, the termination time, the specific time, and the time interval of the sound event. Thus, the time information and the azimuth of the sound event that are included in the first time interval [S1, E1] of the sound signal 310 may be extracted.

Herein, the sound event detecting apparatus may extract a specific time and an azimuth from the first time interval of the sound signal 310. For example, the sound event detecting apparatus may extract, from the first time interval of the sound signal 310, [A1, T1] indicated by azimuth A1 and generation time T1 of the sound event. For another example, the sound event detecting apparatus may extract, from the first time interval of the sound signal 310, [A1, T1] indicated by azimuth A1 and termination time T1 of the sound event. For still another example, the sound event detecting apparatus may extract, from the first time interval of the sound signal 310, [A1, T1] indicated by azimuth A1 and specific time T1, which is not the generation time and the termination time, of the sound event.

For example, as illustrated, time information and an azimuth of a sound event in time frame T2 may be analyzed. In the example, a horizontal axis indicates an azimuth, for example, 0° to 90° corresponding to a polar pattern of a directional microphone, and a vertical axis indicates energy.

Although azimuths in time frame T2 are indicated as A1 and A2 in FIG. 3, the example illustrated in FIG. 3 is described under the assumption that a sound event having azimuth A1 is generated at time T1. That is, it is assumed that a sound event having azimuth A1 is generated at time T1, and a sound event having azimuth A2 is generated at time T2.

Thus, based on the analyzing, the sound event having azimuth A1 is previously generated at time T1 and continues until a current time, T2. In addition, the sound event having azimuth A2 is newly generated at time T2. Thus, since one single sound event is present before time T2, [A1, T1] indicated by an azimuth and a generation time of the sound event may be extracted.

Feature information may include information associated with a time interval of a sound signal, and time information and an azimuth of a sound event. That is, the feature information may include an extracted time interval of the sound signal, and extracted time information and azimuth of the sound event.

According to an example embodiment, information associated with a time interval of a sound signal that is included in such feature information may be used to mix sound signals. In addition, time information and an azimuth of a sound event may be used to determine a direction in which the sound event is generated.

According to an example embodiment, a sound signal may be received using one or more directional microphones. For an area in which a sound event is not generated, it may not be necessary to extract time information and an azimuth associated with the sound event in the area, and thus the sound event detecting apparatus may reduce an amount of calculation or computation, compared to when using a 360° omnidirectional microphone.

Figure 4:
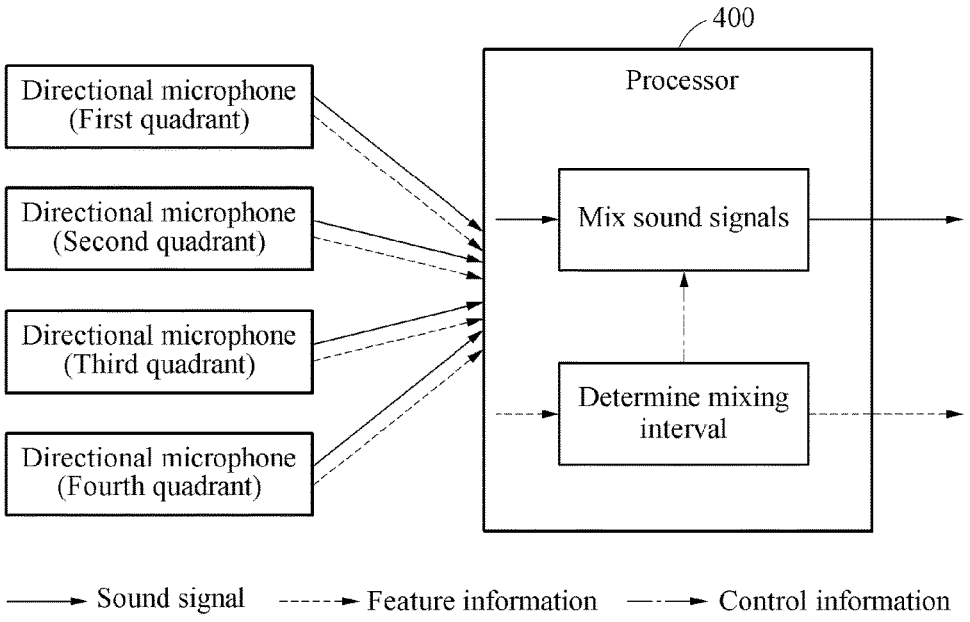
FIG. 4 is a diagram illustrating an example of how to mix sound signals received by directional microphones according to an example embodiment.

FIG. 4 is a diagram illustrating an example of how to mix sound signals received by directional microphones according to an example embodiment.

Referring to FIG. 4, a sound event detecting apparatus includes a processor 400. The processor 400 may identify feature information extracted from a sound signal received by each of directional microphones. The feature information may include a time interval of the sound signal, and time information and an azimuth of a sound event.

The processor 400 may determine a mixing interval to mix sound signals using the time interval of the sound signal included in the feature information. Herein, control information may be used to mix the sound signals.

The control signal may include information associated with the mixing interval and the sound signals to be mixed. In detail, the mixing interval may be determined based on a time interval of a sound signal. The sound signals to be mixed may be sound signals to be mixed in the mixing interval. For example, when mixing a first sound signal received from a first quadrant and a third sound signal received from a third quadrant, the first sound signal and the third sound signal may be sound signals to be mixed, and a time interval in which the first sound signal and the third sound signal are mixed may be a mixing interval.

The processor 400 may determine whether to mix a sound signal received from each of quadrants based on a time interval of the sound signal. For example, in a case in which sound events are received from directional microphones in the first quadrant and the third quadrant, only sound signals received from the directional microphones in the first quadrant and the third quadrant may be mixed.

In this example, a mixing interval may be determined based on a time interval of each of the sound signals received from the directional microphones in the first quadrant and the third quadrant. The processor 400 may mix the sound signals received from the directional microphones in the first quadrant and the third quadrant by comparing a time interval of the sound signal received from the directional microphone in the first quadrant and a time interval of the sound signal received from the directional microphone in the third quadrant. In this example, a sound signal corresponding to a second quadrant and a fourth quadrant from which a sound event is not generated may not be used for the mixing.

In another example, the sound event detecting apparatus includes the processor 400. The processor 400 may extract feature information from a sound signal received from each directional microphone. The feature information includes a time interval of the sound signal, and time information and an azimuth of a sound event.

For example, the processor 400 may extract feature information from a sound signal received from a directional microphone having a polar pattern corresponding to a first quadrant. The processor 400 may extract feature information from a sound signal received from a directional microphone having a polar pattern corresponding to a second quadrant.

The processor 400 may extract feature information from a sound signal received from a directional microphone having a polar pattern corresponding to a third quadrant. The processor 400 may extract feature information from a sound signal received from a directional microphone having a polar pattern corresponding to a fourth quadrant.

The processor 400 may determine a mixing interval of the sound signals based on a time interval of each of the sound signals that is included in the extracted feature information.

The processor 400 may determine whether to mix a sound signal received from each of the quadrants based on a time interval of the sound signal. For example, in a case in which sound events are received from the directional microphones in the first quadrant and the third quadrant, only the sound signals received from the directional microphones in the first quadrant and the third quadrant may be mixed.

In this example, a mixing interval may be determined based on a time interval of each of the sound signals received from the directional microphones in the first quadrant and the third quadrant. The processor 400 may mix the sound signals received from the directional microphones in the first quadrant and the third quadrant by comparing the time interval of the sound signal received from the directional microphone in the first quadrant and the time interval of the sound signal received from the directional microphone in the third quadrant. In this example, the sound signals corresponding to the second quadrant and the fourth quadrant from which a sound event is not generated may not be used for the mixing.

Figure 5:
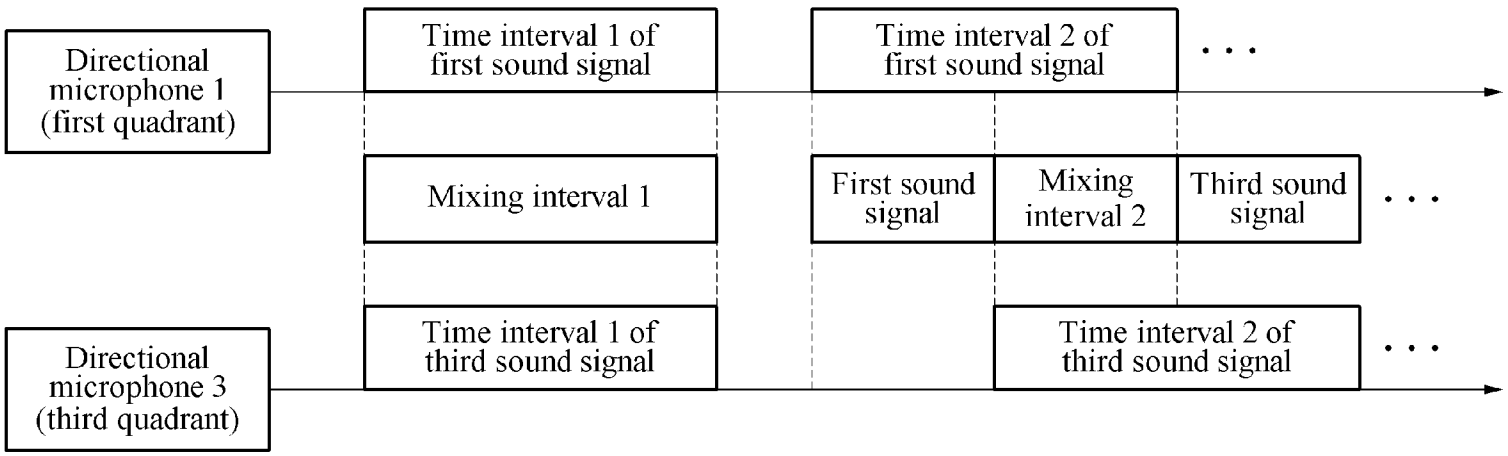
FIG. 5 is a diagram illustrating an example of how to mix sound signals according to an example embodiment.

FIG. 5 is a diagram illustrating an example of how to mix sound signals according to an example embodiment.

Referring to FIG. 5, a first directional microphone may receive a first sound signal corresponding to a first quadrant, and a third directional microphone may receive a third sound signal corresponding to a third quadrant.

The first sound signal corresponding to the first quadrant that is received from the first directional microphone may have one or more time intervals. For example, the first sound signal may include a first time interval, a second time interval, and other subsequent time intervals. Also, the third sound signal corresponding to the third quadrant that is received from the third directional microphone may have one or more time intervals. For example, the third sound signal may include a first time interval, a second time interval, and other subsequent time intervals.

In an example, in a case in which the first time interval of the first sound signal is the same as the first time interval of the third sound signal, this same time interval may be determined to be a first mixing interval. The first sound signal and the third sound signal may then be mixed together in the first mixing interval.

In another example, in a case in which the second time interval of the first sound signal differs from the second time interval of the third sound signal, a common time interval between the two second time intervals may be determined to be a second mixing interval. The first sound signal and the third sound signal may then be mixed together in the second mixing interval. Thus, only the first sound signal may be present before the second mixing interval, the first sound signal and the third sound signal may be present by being mixed together during the second mixing interval, and only the third sound signal may be present after the second mixing interval.

The example method of mixing sound signals described above with reference to FIG. 5 may be applicable to other examples described with reference to remaining drawings.

Figure 6:
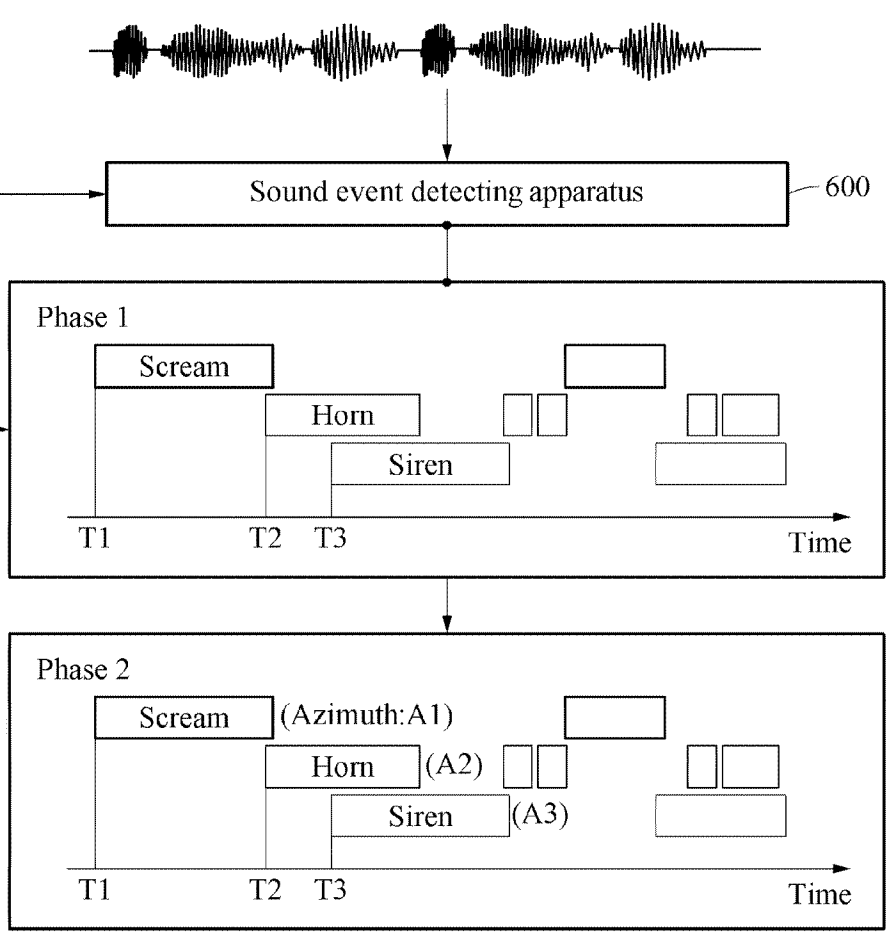
FIG. 6 is a diagram illustrating an example of how an apparatus for detecting a sound event detects a sound event according to an example embodiment.

FIG. 6 is a diagram illustrating an example of how a sound event detecting apparatus detects a sound event according to an example embodiment.

Referring to FIG. 6, a sound event detecting apparatus 600 may receive or identify a mixed sound signal and feature information. The sound event detecting apparatus 600 may operate only in a time interval in which a sound signal is present, and may thus reduce an amount of calculation or computation.

Herein, training may be completed for the sound event detecting apparatus 600 using sufficient data on a sound event, which is a target to be recognized. For example, the sound event detecting apparatus 600 may be an apparatus to which a neural network trained from sufficient data on a sound event through machine learning, deep learning, and artificial intelligence (AI) is applied.

In a first phase, the sound event detecting apparatus 600 identifies at least one sound event from a mixed sound signal. Herein, the sound event detecting apparatus 600 identifies time information of the identified sound event. The time formation of the sound event may include a generation time and/or a termination time of the sound event, and/or a specific time and/or a time interval of the sound event.

For example, as illustrated, the sound event detecting apparatus 600 identifies a scream, which is a sound event generated at generation time T1. In addition, the sound event detecting apparatus 600 identifies a horn sound, which is a sound event generated at generation time T2. In addition, the sound event detecting apparatus 600 identifies a siren, which is a sound event generated at generation time T3.

In an example, the sound event detecting apparatus 600 identifies a termination time of a sound event, in addition to a generation time of the sound event. When using both the generation time and the termination time, the sound event detecting apparatus 600 may improve accuracy in mapping the sound event and an azimuth thereof. This is because accuracy may be improved when determining a direction in which a sound event is generated by mapping a corresponding azimuth to both a generation time and a termination time of the sound event, compared to when determining the direction by mapping a corresponding azimuth to only the generation time of the sound event.

Herein, the sound event detecting apparatus 600 may determine the direction in which the sound event is generated using a specific time of the sound event to be mapped to an azimuth of the sound event, in addition to the generation time and the termination time of the sound event.

In a second phase, the sound event detecting apparatus 600 compares the generation time of the sound event identified in the first phase and a generation time of the sound event identified from the feature information. Thus, the sound event detecting apparatus 600 may map the sound event identified in the first phase to an azimuth.

For example, as illustrated, azimuths and generation times of the sound events identified from the feature information are indicated by [A1, T1], [A2, T2], and [A3, T3]. Since the sound event identified from the feature information has azimuth A1 at generation time T1, the sound event detecting apparatus 600 may map, to A1, an azimuth of the scream which is the sound event generated at T1 in the first phase.

In addition, since the sound event identified from the feature information has azimuth A2 at generation time T2, the sound event detecting apparatus 600 may map, to A2, an azimuth of the horn sound which is the sound event generated at T2 in the first phase.

In addition, since the sound event identified from the feature information has azimuth A3 at generation time T3, the sound event detecting apparatus 600 may map, to A3, an azimuth of the siren which is the sound event generated at T3 in the first phase.

Thus, the sound event detecting apparatus 600 may determine a direction in which each of the sound events is generated based on the mapped azimuths.

Figure 7:
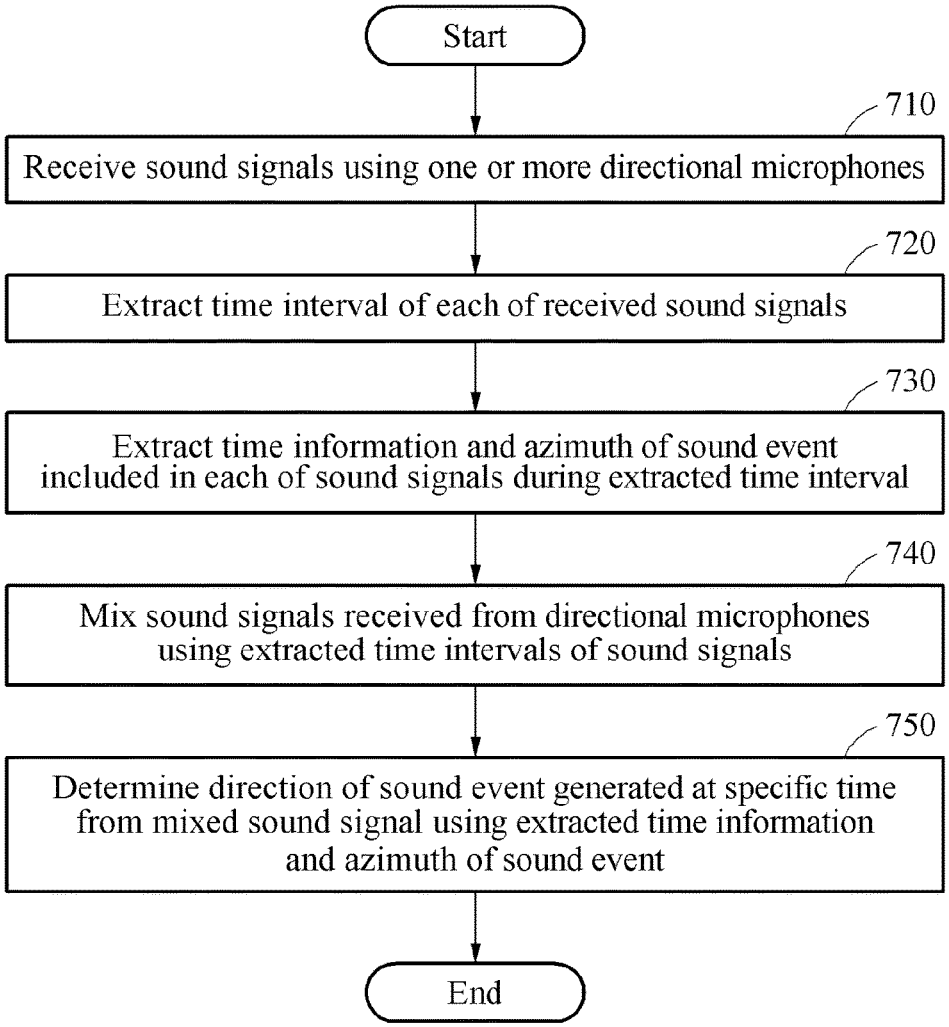
FIG. 7 is a flowchart illustrating an example of a method of detecting a sound event that is performed by an apparatus for detecting a sound event according to an example embodiment.

FIG. 7 is a flowchart illustrating an example of a method of detecting a sound event that is performed by a sound event detecting apparatus according to an example embodiment. Hereinafter, the method of detecting a sound event will be simply referred to as a sound event detecting method.

Referring to FIG. 7, in operation 710, a sound event detecting apparatus receives sound signals using one or more directional microphones.

In sound recognition, a target to be recognized may be classified into a sound event and a sound scene. The sound event indicates a sound object that is generated at a specific time and then disappears, for example, a scream, a dog bark, and so forth. The sound scene indicates a set of sound events occurring in a specific place, for example, a restaurant, an office, a home, a park, and so forth.

A directional microphone has a polar pattern, and may detect a sound event that is generated in all directions in a radius of 360° around a listener. For example, a first sound event may be detected by a first directional microphone, a second sound event may be detected by a second directional microphone, a third sound event may be detected by a third directional microphone, and a fourth sound event may be detected by a fourth directional microphone. Herein, a single directional microphone may include the first, second, third, and fourth microphones.

The first through fourth sound events may be generated simultaneously, or at different times. The generated first through fourth sound events may be received by the first through fourth directional microphones, respectively. For example, the first and second sound events may be generated simultaneously, and the third and fourth sound events may be generated at different times. The single directional microphone including the first through fourth directional microphones may receive the first and second sound events that are generated simultaneously, and the third and fourth sound events that are generated at different times.

Herein, a directional microphone receiving a sound event may have a polar pattern, and the polar pattern may indicate an area in which the directional microphone receives a sound signal and/or a sound event. Herein, the sound event may be included in the sound signal.

For example, in a case in which a polar pattern of a directional microphone is divided by 180°, the directional microphone may receive a sound signal and/or a sound event generated at 0° to 180°, or a sound signal and/or a sound event generated at 180° to 360°.

For another example, in case in which a polar pattern of a directional microphone is divided by 120°, the directional microphone may receive a sound signal and/or a sound event generated at 0° to 120°, a sound signal and/or a sound event generated at 120° to 240°, or a sound signal and/or a sound event generated at 240° to 360°.

For still another example, in case in which a polar pattern of a directional microphone is divided by 90°, the directional microphone may receive a sound signal and/or a sound event generated at 0° to 90°, a sound signal and/or a sound event generated at 90° to 180°, a sound signal and/or a sound event generated at 180° to 270°, or a sound signal and/or a sound event generated at 270° to 360°.

For yet another example, in case in which a polar pattern of a directional microphone is divided by 60°, the directional microphone may receive a sound signal and/or a sound event generated at 0° to 60°, a sound signal and/or a sound event generated at 60° to 120°, a sound signal and/or a sound event generated at 120° to 180°, a sound signal and/or a sound event generated at 180° to 240°, a sound signal and/or a sound event generated at 240° to 300°, or a sound signal and/or a sound event generated at 300° to 360°.

Other patterns may be used as a polar pattern of a directional microphone based on a situation. Alternatively, the polar pattern of the directional microphone may be adjusted based on a situation and controlled to be another pattern.

Thus, sound signals and/or sound events may be received separately by directional microphones, and a feature of each of the sound signals and/or the sound events may be analyzed. When separately receiving the sound signals and/or the sound events, a sound signal and/or a sound event that is close to a directional microphone may be received by the directional microphone although a magnitude of the sound signal and/or the sound event is relatively small dB. However, a sound signal and/or a sound event that is remote from a directional microphone may be received by the directional microphone when a magnitude of the sound signal and/or the sound event is relatively large dB.

In operation 720, the sound event detecting apparatus extracts a time interval of each of the sound signals.

The sound event detecting apparatus may receive a sound signal. The sound signal may include one or more sound events generated at a specific time. The sound event detecting apparatus may extract, from the received sound signal, a time interval of the sound signal.

The sound signal may include one or more time intervals. For example, a first time interval may be indicated by [S1, E1] including start time S1 and end time E1. A second time interval may be indicated by [S2, E2] including start time S2 and end time E2. A third time interval may be indicated by [S3, E3] including start time S3 and end time E3. That is, the sound signal may include the time intervals including, for example, the first time interval, the second time interval, and the third time interval.

In operation 730, the sound event detecting apparatus extracts time information, or a time interval, and an azimuth of a sound event included in the sound signals during the extracted time interval.

The sound event detecting apparatus may extract information associated with a sound event included in an extracted time interval of a sound signal. The information associated with the sound event may include time information and an azimuth of the sound event. The time information of the sound event may include a time interval in which the sound event lasts, and a generation time and a termination time of the sound event. In addition to the generation time and the termination time, the time information of the sound event may include a specific time of the sound event. The specific time of the sound event may indicate a specific point in time in the time interval during which the sound event lasts.

For example, the sound event detecting apparatus may extract a first time interval of a sound event based on time information of the sound event and an azimuth of the sound event. In detail, the sound event detecting apparatus may extract, from a sound event included in a first time interval [S1, E1] of a sound signal, time information and an azimuth of the sound event. A generation time, a termination time, a specific time, and a time interval of the sound event may be included in the first time interval [S1, E1] of the sound signal. The time information of the sound event may include information associated with the generation time, the termination time, the specific time, and the time interval of the sound event. Thus, the sound event detecting apparatus may extract the generation time of the sound event that is included in the first time interval [S1, E1] of the sound signal based on the azimuth and the time information of the sound event.

Herein, the sound event detecting apparatus may extract a specific time and an azimuth from the first time interval of the sound signal. For example, the sound event detecting apparatus may extract, from the first time interval of the sound signal, [A1, T1] indicated by azimuth A1 of the sound event and generation time T1 of the sound event. For another example, the sound event detecting apparatus may extract, from the first time interval of the sound signal, [A1, T1] indicated by azimuth A1 of the sound event and termination time T1 of the sound event. For still another example, the sound event detecting apparatus may extract, from the first time interval, [A1, T1] indicated by azimuth A1 of the sound event and a specific time T1 of the sound event, which is not the generation time and the termination time of the sound event.

Feature information may include information associated with a time interval of a sound signal, and time information and an azimuth of a sound event. That is, the feature information may include an extracted time interval of the sound signal, and extracted time information and azimuth of the sound event.

In operation 740, the sound event detecting apparatus mixes the sound signals received from the directional microphones using the extracted time intervals of the sound signals.

In an example, the sound event detecting apparatus may include a processor. The processor may extract feature information from a sound signal received from each of the directional microphones. The feature information may include a time interval of the sound signal, and time information and an azimuth of a sound event.

For example, the processor may extract feature information from a sound signal received from a directional microphone having a polar pattern corresponding to a first quadrant. The processor may also extract feature information from a sound signal received from a directional microphone having a polar pattern corresponding to a second quadrant. The processor may also extract feature information from a sound signal received from a directional microphone having a polar pattern corresponding to a third quadrant. The processor may also extract feature information from a sound signal received from a directional microphone having a polar pattern corresponding to a fourth quadrant.

The processor may determine a mixing interval of the sound signals using the extracted time intervals of the sound signals included in the extracted feature information. For example, the processor may determine whether to mix the sound signals received from the quadrants based on the time intervals of the sound signals. In detail, when sound signals are received from directional microphones in a first quadrant and a third quadrant, the processor may mix only the sound signals received from the directional microphones in the first quadrant and the third quadrant.

In this example, the mixing interval may be determined based on time intervals of the sound signals received from the directional microphones in the first quadrant and the third quadrant. For example, the processor may compare the time interval of the sound signal received from the directional microphone in the first quadrant and the time interval of the sound signal received from the directional microphone in the third quadrant, and mix the sound signals received from the directional microphones in the first quadrant and the third quadrant. In this example, the processor may not mix sound signals corresponding to a second quadrant and a fourth quadrant from which a sound event is not generated.

In operation 750, the sound event detecting apparatus determines a direction of a sound event generated at a specific time from the mixed sound signal obtained through the mixing, using the extracted time interval and azimuth of the sound event.

The sound event detecting apparatus may receive or identify the mixed sound signal and the feature information. The sound event detecting apparatus may operate only in a time interval in which a sound signal is present, thereby reducing an amount of calculation or computation.

In a first phase, the sound event detecting apparatus may identify at least one sound event from the mixed sound signal. The sound event detecting apparatus may identify time information of the identified sound event. The time information of the sound event may include a generation time, a termination time, a specific time, and/or a time interval of the sound event.

For example, the sound event detecting apparatus may identify a scream, which is a sound event generated at generation time T1. The sound event detecting apparatus may also identify a horn sound, which is a sound event generated at generation time T2. The sound event detecting apparatus may also identify a siren, which is a sound event generated at generation time T3.

In an example, the sound event detecting apparatus may identify a termination time of a sound event in addition to a generation time of the sound event. When using the generation time and the termination time together, the sound event detecting apparatus may improve accuracy in mapping an extracted sound event and an extracted azimuth. This is because, by determining a direction in which a sound event is generated by mapping an azimuth corresponding to a generation time and a termination time of the sound event, accuracy may be improved compared to by determining the direction in which the sound event is generated by mapping an azimuth corresponding to the generation time of the sound event.

Herein, the sound event detecting apparatus may determine the direction in which the sound event is generated using, in addition to the generation time and the termination time of the sound event, a specific time of the sound event to be mapped to an azimuth of the sound event.

In a second phase, the sound event detecting apparatus may compare the generation time of the sound event that is identified in the first phase and a generation time of the sound event identified from the feature information. Thus, the sound event detecting apparatus may map the sound event identified in the first phase to an azimuth.

For example, an azimuth and a generation time of a sound event identified from feature information may be indicated by [A1, T1], [A2, T2], and [A3, T3]. In this example, the sound event identified from the feature information may have azimuth A1 at generation time T1 of the sound event, and thus the sound event detecting apparatus may map, to A1, an azimuth of a scream, which is a sound event generated at T1 in the first phase.

For another example, a sound event identified from feature information has azimuth A2 at generation time T2, and thus the sound event detecting apparatus may map, to A2, an azimuth of a horn sound, which is a sound event generated at T2 in the first phase.

For still another example, a sound event identified from feature information has azimuth A3 at generation time T3, and thus the sound event detecting apparatus may map, to A3, an azimuth of a siren, which is a sound event generated at T3 in the first phase. Thus, the sound event detecting apparatus may determine a direction in which each sound event is generated based on a mapped azimuth.

Figure 8:
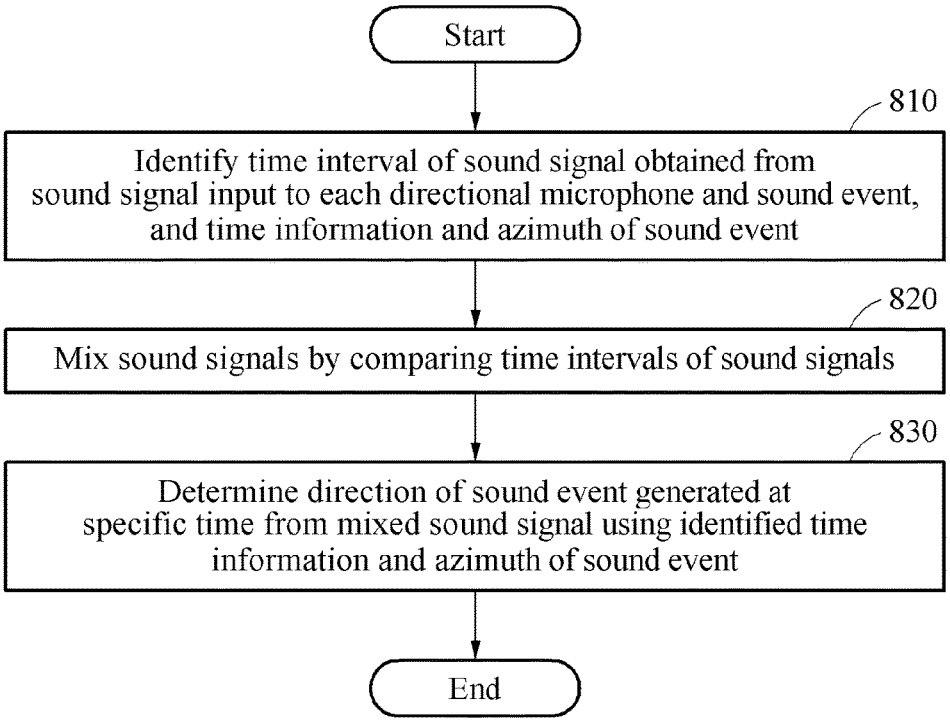
FIG. 8 is a flowchart illustrating another example of a method of detecting a sound event that is performed by an apparatus for detecting a sound event according to an example embodiment.

FIG. 8 is a flowchart illustrating another example of a sound event detecting method performed by a sound event detecting apparatus according to an example embodiment.

Referring to FIG. 8, in operation 810, the sound event detecting apparatus identifies a time interval of a sound signal input to each directional microphone that is obtained from the sound signal and a sound event, and time information and an azimuth of the sound event.

The sound event detecting apparatus may identify a sound signal and/or a sound event, a time interval of the sound signal, and time information and an azimuth of the sound event. Herein, the sound signal may include one or more sound events generated at a specific time.

A sound signal may include one or more time intervals. For example, a first time interval may be indicated by [S1, E1] including start time S1 and end time E1. A second time interval may be indicated by [S2, E2] including start time S2 and end time E2. A third time interval may be indicated by [S3, E3] including start time S3 and end time E3. That is, the sound signal may include the time intervals including, for example, the first time interval, the second time interval, the third time interval, and other subsequent time intervals.

The sound event detecting apparatus may identify the time information and the azimuth of the sound event included in the identified time interval of the sound signal. Herein, the time information of the sound event may include information associated with a time interval in which the sound event lasts, and a generation time and a termination time of the sound event. The time information of the sound event may also include a specific time of the sound event in addition to the generation time and the termination time. The specific time of the sound event may indicate a specific point in time in the time interval during which the sound event lasts.

For example, the sound event detecting apparatus may identify a first time interval of a sound event based on time information and an azimuth of the sound event. In detail, the sound event detecting apparatus may identify time information and an azimuth that are extracted from a sound event included in a first time interval indicated by [S1, E1] of a sound signal. A generation time, a termination time, a specific time, and a time interval of the sound event may be included in the first time interval [S1, E1] of the sound signal. The time information of the sound event may include information associated with the generation time, the termination time, the specific time, and the time interval of the sound event. Thus, the generation time of the sound event may be identified based on the time information and the azimuth of the sound event.

Herein, the sound event detecting apparatus may identify a specific time and an azimuth from the first time interval of the sound event. For example, the sound event detecting apparatus may identify [A1, T1] based on an azimuth A1 and generation time T1 in the first time interval of the sound event. For another example, the sound event detecting apparatus may identify [A1, T1] based on an azimuth A1 and termination time T1 in the first time interval of the sound event. For still another example, the sound event detecting apparatus may identify [A1, T1] based on an azimuth A1 and specific time T1, which is not the generation time and the termination time, in the first time interval of the sound event.

Feature information may include information associated with a time interval of a sound signal, and time information and an azimuth of a sound event. That is, the feature information may include an extracted time interval of the sound signal, and extracted time information and azimuth of the sound event.

In operation 820, the sound event detecting apparatus mixes sound signals by comparing time intervals of the sound signals.

In an example, the sound event detecting apparatus may include a processor. The processor may identify feature information of a sound signal received from each directional microphone. The feature information may include a time interval of the sound signal, and time information and an azimuth of a sound event.

The processor may determine a mixing interval of the sound signals using the time intervals of the sound signals included in the feature information. The processor may determine whether to mix a sound signal received from each quadrant based on the time intervals of the sound signals. For example, when sound signals are received from directional microphones in a first quadrant and a third quadrant, the processor may mix only the sound signals received from the directional microphones in the first quadrant and the third quadrant.

In this example, the mixing interval may be determined based on time intervals of the sound signals received from the directional microphones in the first quadrant and the third quadrant. For example, the processor may compare the time interval of the sound signal received from the directional microphone in the first quadrant and the time interval of the sound signal received from the directional microphone in the third quadrant, and mix the sound signals received from the directional microphones in the first quadrant and the third quadrant. In this example, the processor may not use, for the mixing, a sound signal corresponding to a second quadrant and a fourth quadrant from which a sound event is not generated.

In operation 830, the sound event detecting apparatus determines a direction of the sound event generated at a specific time from the mixed sound signal obtained through the mixing, using the time interval and the azimuth of the sound event.

The sound event detecting apparatus may receive or identify the mixed sound signal and the feature information. The sound event detecting apparatus may operate only during a time interval in which a sound signal is present, thereby reducing an amount of calculation or computation.

In a first phase, the sound event detecting apparatus may identify at least one sound event from the mixed sound signal. The sound event detecting apparatus may identify time information of the identified sound event. The time information of the sound event may include a generation time, a termination time, a specific time, and/or a time interval of the sound event.

For example, the sound event detecting apparatus may identify a scream, which is a sound event generated at generation time T1. The sound event detecting apparatus may also identify a horn sound, which is a sound event generated at generation time T2. The sound event detecting apparatus may also identify a siren, which is a sound event generated at generation time T3.

In an example, the sound event detecting apparatus may identify a termination time of a sound event in addition to a generation time of the sound event. Thus, when using the generation time and the termination time together, the sound event detecting apparatus may improve accuracy in mapping the sound event and an azimuth. This is because, by determining a direction in which the sound event is generated by mapping an azimuth corresponding to the generation time and the termination time of the sound event, accuracy may be improved compared to by determining the direction by mapping an azimuth corresponding to the generation time of the sound event.

Herein, the sound event detecting apparatus may determine the direction in which the sound event is generated using, in addition to the generation time and the termination time of the sound event, a specific time of the sound event to be mapped to an azimuth of the sound event.

In a second phase, the sound event detecting apparatus may compare the generation time of the sound event that is identified in the first phase and a generation time of the sound event identified from the feature information. Thus, the sound event detecting apparatus may map the sound event identified in the first phase to an azimuth.

For example, an azimuth and a generation time of a sound event identified from feature information may be indicated by [A1, T1], [A2, T2], and [A3, T3]. In this example, the sound event identified from the feature information may have azimuth A1 at generation time T1 of the sound event, and thus the sound event detecting apparatus may map, to A1, an azimuth of a scream, which is the sound event generated at T1 in the first phase.

For another example, the sound event identified from the feature information may have azimuth A2 at generation time T2, and thus the sound event detecting apparatus may map, to A2, an azimuth of a horn sound, which is the sound event generated at T2 in the first phase.

For still another example, the sound event identified from the feature information may have azimuth A3 at generation time T3, and thus the sound event detecting apparatus may map, to A3, an azimuth of a siren, which is the sound event generated at T3 in the first phase. Thus, the sound event detecting apparatus may determine a direction of each sound event based on a mapped azimuth.

The units described herein may be implemented using hardware components and software components. For example, the hardware components may include microphones, amplifiers, band-pass filters, audio to digital convertors, non-transitory computer memory and processing devices. A processing device may be implemented using one or more general-purpose or special purpose computers, such as, for example, a processor, a controller and an arithmetic logic unit (ALU), a digital signal processor, a microcomputer, a field programmable array (FPA), a programmable logic unit (PLU), a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums. The non-transitory computer readable recording medium may include any data storage device that can store data which can be thereafter read by a computer system or processing device.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A method of detecting a sound event, the method comprising:

receiving sound signals using one or more directional microphones;

extracting a time interval of each of the sound signals;

extracting time information and an azimuth of a sound event included in the sound signals, during the extracted time interval;

mixing the sound signals received from the directional microphones using the extracted time interval; and determining a direction of the sound event generated at a specific time from a mixed sound signal obtained through the mixing, using the extracted time information and azimuth of the sound event.

2. The method of claim 1, wherein the mixing of the sound signals comprises:

determining a mixing interval in which the sound signals are mixed by comparing the extracted time intervals of the sound signals.

3. The method of claim 2, wherein the determining of the mixing interval comprises:

determining whether sound signals are generated in a same time interval by comparing the time intervals of the sound signals received by the directional microphones, and selectively mixing the sound signals generated in the same time interval.

4. The method of claim 1, wherein the determining of the direction of the sound event comprises:

identifying the time information of the sound event from the mixed sound signal, and determining the direction of the sound event based on the azimuth corresponding to the identified time information of the sound event.

5. The method of claim 4, wherein the determining of the direction of the sound event comprises:

determining the direction of the sound event using the specific time of the sound event included in the identified time information of the sound event.

6. The method of claim 1, wherein a polar pattern of each of the directional microphones indicates an area in which each of the directional microphones receives a sound signal, wherein, through a combination of polar patterns of the directional microphones, the sound signals are received from all directions.

7. A method of detecting a sound event, the method comprising:

identifying a time interval of a sound signal input to each of directional microphones that is obtained from the sound signal and a sound event, and time information and an azimuth of the sound event;

mixing the input sound signals by comparing the identified time intervals of the sound signals; and determining a direction of the sound event generated at a specific time from a mixed sound signal obtained through the mixing, using the identified time information and azimuth of the sound event.

8. The method of claim 7, wherein the mixing of the sound signals comprises:

determining a mixing interval in which the sound signals are mixed by comparing the time intervals of the sound signals.

9. The method of claim 8, wherein the determining of the mixing interval comprises:

determining whether sound signals are generated in a same time interval by comparing the time intervals of the sound signals received by the directional microphones, and selectively mixing the sound signals generated in the same time interval.

10. The method of claim 7, wherein the determining of the direction of the sound event comprises:

identifying the time information of the sound event from the mixed sound signal, and determining the direction of the sound event based on the azimuth corresponding to the identified time information of the sound event.

11. An apparatus for detecting a sound event, the apparatus comprising:

a processor, wherein the processor is configured to:

receive sound signals using one or more directional microphones;

extract a time interval of each of the sound signals;

extract time information and an azimuth of a sound event included in the sound signals, during the extracted time interval;

mix the sound signals received from the directional microphones, using the extracted time interval; and determine a direction of the sound event generated at a specific time from a mixed signal obtained through the mixing, using the extracted time information and azimuth of the sound event.

12. The apparatus of claim 11, wherein, for the mixing of the sound signals, the processor is further configured to determine a mixing interval in which the sound signals are mixed by comparing the extracted time intervals of the sound signals.

13. The apparatus of claim 12, wherein, for the determining of the mixing interval, the processor is further configured to determine whether sound signals are generated in a same time interval by comparing the time intervals of the sound signals received by the directional microphones, and selectively mix the sound signals generated in the same time interval.

14. The apparatus of claim 11, wherein, for the determining of the direction of the sound event, the processor is further configured to identify the time information of the sound event from the mixed sound signal, and determine the direction of the sound event based on the azimuth corresponding to the identified time information of the sound event.

15. The apparatus of claim 14, wherein, for the determining of the direction of the sound event, the processor is further configured to determine the direction of the sound event using the specific time of the sound event included in the identified time information of the sound event.

16. The apparatus of claim 11, wherein a polar pattern of each of the directional microphones indicates an area in which each of the directional microphones receives a sound signal, wherein, through a combination of polar patterns of the directional microphones, the sound signals are received from all directions.

* * * * *